US008536451B2

(12) United States Patent
Schmidt

(10) Patent No.: US 8,536,451 B2
(45) Date of Patent: Sep. 17, 2013

(54) HIGH-VOLTAGE CONNECTION AND ELECTRIC RAIL VEHICLE HAVING A HIGH-VOLTAGE CONNECTION

(75) Inventor: Gerhard Schmidt, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 76 days.

(21) Appl. No.: 13/131,148

(22) PCT Filed: Sep. 15, 2009

(86) PCT No.: PCT/EP2009/061937

§ 371 (c)(1),
(2), (4) Date: Jun. 29, 2011

(87) PCT Pub. No.: WO2010/060663

PCT Pub. Date: Jun. 3, 2010

(65) Prior Publication Data

US 2011/0253410 A1 Oct. 20, 2011

(30) Foreign Application Priority Data

Nov. 25, 2008 (DE) ..... 10 2008 059 174

(51) Int. Cl.
*H02G 7/20* (2006.01)

(52) U.S. Cl.
USPC .... 174/43; 174/137 R; 174/138 D; 174/45 R; 174/138 R; 200/49; 191/32

(58) Field of Classification Search
USPC ..... 174/43, 137 R, 138 D, 45 R, 44, 174/138 R, 15.5, 15.6; 200/49; 191/32; 238/6, 282
See application file for complete search history.

(56) References Cited

U.S. PATENT DOCUMENTS

| | | | | |
|---|---|---|---|---|
| 1,815,392 | A * | 7/1931 | Alsaker | 200/48 CB |
| 2,003,017 | A | 5/1935 | Smith | |
| 4,053,706 | A * | 10/1977 | Houston et al. | 174/149 R |
| 5,036,162 | A * | 7/1991 | Zajfert | 174/43 |
| 6,525,265 | B1 * | 2/2003 | Leijon et al. | 174/15.5 |

FOREIGN PATENT DOCUMENTS

| | | | |
|---|---|---|---|
| CN | 2033780 | U | 3/1989 |
| DE | 121628 | C | 9/1899 |
| DE | 4323540 | C1 | 12/1994 |
| DE | 19614060 | C1 | 5/1997 |
| DE | 19614427 | A1 | 10/1997 |
| FR | 2713183 | A1 | 6/1995 |

* cited by examiner

*Primary Examiner* — Dhirubhai R Patel
(74) *Attorney, Agent, or Firm* — Laurence A. Greenberg; Werner H. Stemer; Ralph E. Locher

(57) ABSTRACT

A high-voltage connection between two post insulators which can be moved relative to one another. In order to be able to implement such a high-voltage connection in the most compact form possible with regard to insulating air gaps, the high-voltage connection has a current conduction rod, which is surrounded by an insulating body and mounted at one end thereof on the one post insulator at an adjustable distance and at the other end thereof is held on the other post insulator. Outgoing current leads are connected to each end of the current conduction rod. An electric rail vehicle has at least two cars, each having a high-voltage line run in the roof and each having a post insulator on the roof in the area of the mutually facing ends of the cars. The high-voltage connection according to the invention is used in order to achieve an aerodynamically favorable design in the bridging area of the roof area of the cars.

6 Claims, 1 Drawing Sheet

HIGH-VOLTAGE CONNECTION AND ELECTRIC RAIL VEHICLE HAVING A HIGH-VOLTAGE CONNECTION

BACKGROUND OF THE INVENTION

Field of the Invention

A high-voltage connection which runs between two supporting insulators which can move relative to one another is known from a publication "Elektronische Ausrüstung and Bordnetz" [Electronic equipment and on-board power supply system], which can be found at the Internet address http://ice-fansite.com/joomla/ index.php?option=content&task=view&id=261. In this case, the supporting insulators are located in the transitional area between respectively adjacent wagons of an electrical rail vehicle. A double line at high-voltage potential runs between the supporting insulators which can move relative to one another. This double line must hang down when the rail vehicle is in the rest state, in order to absorb the relative movement between the two supporting insulators when in motion. This in turn means that a relatively large amount of space must be made available in order to comply with the isolating air gaps in the area of the double line, and this is at the expense of the electrical rail vehicle having good aerodynamics.

BRIEF SUMMARY OF THE INVENTION

The invention is based on a high-voltage connection between two supporting insulators which can move relative to one another, and is based on the object of designing a high-voltage connection between two such supporting insulators such that relatively short isolating air gaps are sufficient.

In order to achieve this object, the high-voltage connection according to the invention has a power line rod which is surrounded by an insulating body and is fitted, such that the distance can be adapted, at one of its ends to one supporting insulator and is held at its other end on the other supporting insulator; an outgoing power line is electrically connected to one end of the power line rod, and another outgoing power line is electrically connected to the other end of the power line rod.

One major advantage of the high-voltage connection according to the invention is that the air gaps which are required for isolation can be kept relatively short by means of the power line rod with the compact form of an insulating body surrounding it, preferably an insulator with ribs, because the power line rod together with its insulating body changes its position only in a relatively short spatial profile, even in the event of relatively large movements of the supporting insulators with respect to one another, in such a way that parts which are located in the area of the high-voltage connection and are at ground potential, for example metal walls, can surround the high-voltage connection relatively closely and can run relatively closely along it.

With regard to the outgoing power lines, the high-voltage connection according to the invention may be designed differently; for simple assembly reasons, it is considered to be advantageous for the outgoing power lines to be in the form of power line cables, and for each to be firmly connected to the power line rod. Since these power line cables lead to electrical connections which are fitted adjacent to the supporting insulators, they can be made relatively short; there is then no interference at all between them and the required spatial profile of the high-voltage connection ensuring, in a simple manner, that the power line rod can move freely with its insulating body when the two supporting insulators move relative to one another.

In another advantageous embodiment of the high-voltage connection according to the invention, the outgoing power lines are in the form of a power line cables, and are connected to the power line rod by means of sliding contacts.

This has the advantageous feature that the outgoing power lines can be made particularly short, thus reliably avoiding isolation problems.

In order to avoid excessively severe loading the supporting insulators, as well as the power line rod, when relatively large movements take place between the two supporting insulators, it is considered to be advantageous for the power line rod to be mounted on the supporting insulators such that it can move spherically or in a universally jointed manner.

Another advantageous possible way to absorb the position changes between the two supporting insulators is to design at least one bearing point of the power line rod on the supporting insulators such that it can move in the direction of the power line rod.

It is considered to be particularly advantageous if for the power line rod to have a power line movement or sliding piece, which is held such that it can move longitudinally, at at least one end. This is because a power line rod designed in this way makes it possible to ensure in a relatively simple design manner that the position changes between the two supporting insulators are absorbed.

In order to ensure that the high-voltage connection according to the invention can be made relatively flat between the two supporting insulators which can move relative to one another, it is advantageous if one end of a power line arm is held at at least one end of the power line rod such that it can rotate horizontally and such that it is electrically connected to the power line rod, if one end of a further power line arm is held on the supporting insulator which is adjacent to this end of the power line rod, such that it can rotate horizontally, and is electrically connected to the outgoing power line, and if the respective other ends of the two power line arms are mounted on a common axis such that they can rotate horizontally with respect to one another, and are electrically connected to one another.

The invention furthermore relates to an electrical rail vehicle having at least two wagons, each having a high-voltage line which is routed in their roof, and each having a supporting insulator on the roof in the area of the respective mutually facing ends of the wagons, and therefore to an electrical rail vehicle as is described in the publication cited initially.

The high-voltage connection according to the invention is used in order to allow a rail vehicle such as this to be designed to be aerodynamically advantageous in the transitional area from one wagon to the adjacent other wagon. This requires relatively little space for isolation, thus allowing this high-voltage connection to be fitted such that roof claddings can be arranged in the external contour of the roof, in the transitional area from one wagon to the other.

In the case of the rail vehicle according to the invention, the isolator for the power line rod extends at least over the entire area between the ends of the wagons.

It is considered to be particularly advantageous for the supporting insulators each to be arranged above the rotation point of a mechanical coupling which connects the wagons, because an arrangement such as this makes it possible to minimize the longitudinal movements between the adjacent supporting insulators.

In order to explain the invention further:

DESCRIPTION OF THE INVENTION

Figure 1:
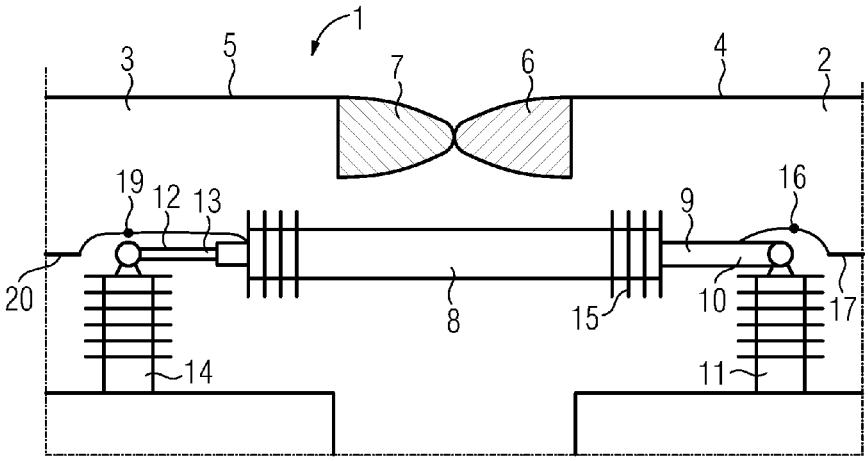
FIG. 1 shows a side view of one exemplary embodiment of a high-voltage connection according to the invention installed in an electrical rail vehicle.

FIG. 1 shows a detail of an electrical rail vehicle 1, which has a wagon 2 and, adjacent to it, a wagon 3. The wagons 2 and 3 have respective roofs 4 and 5. Each respective roof 4 and 5 has a gap bridge 6 and 7, underneath which a high-voltage connection 8 is arranged.

The high-voltage connection 8 has a power line rod 9, which is fitted to a supporting insulator 11 at one of its ends 10, preferably mounted in a universally jointed manner or spherically. The power line rod 9 is provided in the area of its other end 12 with a power line movement piece 13, which can move longitudinally in the power line rod 9. The power line rod 9 is also held at its other end 12 on a further supporting insulator 14, by means of the power line movement piece 13, spherically or in a universally jointed manner.

Figure 2:
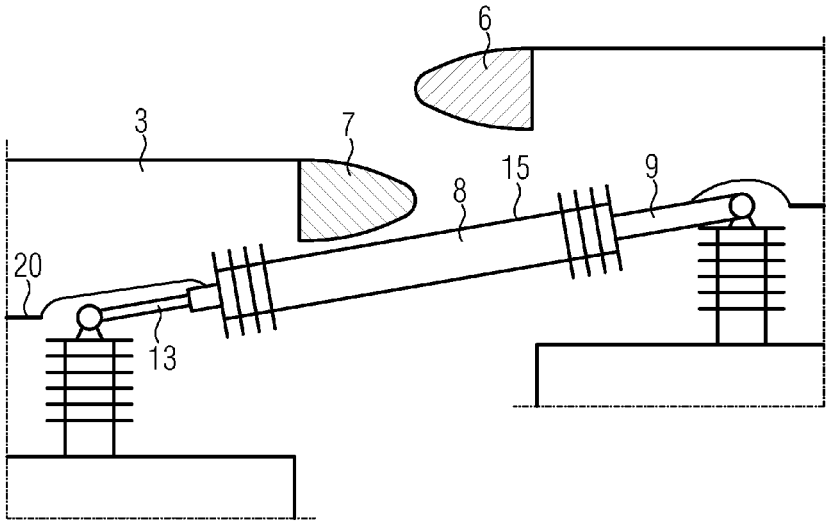
FIG. 2 shows a state of the same exemplary embodiment, in which the adjacent wagons have a relatively large height offset with respect to one another, because of the configuration of the track.

If a height offset occurs between the two wagons 2 and 3, to be precise their supporting insulators 11 and 14, while the illustrated electrical rail vehicle is in motion, then the length of the power line rod 9 is increased by extending the power movement piece 13; the power line rod 9 is then inclined with respect to the horizontal, as can be seen in FIG. 2. A compact insulating body 15 with ribs in the form of an isolator on the power line rod 9 nevertheless ensures that the air gap required for isolation from the metal parts of the wagons 2 and 3 is provided, in such a way that, even in this position of the high-voltage connection, there is an adequate separation between the gap bridge 7 on the further wagon 3 and the power line rod 9.

A power line 16, which originates from one end 10 of the power line rod 9, to a connecting piece 17 is in this case in the form of a power line cable, and is connected over a relatively short distance to the connecting piece 17, to be precise to a high-voltage line which is not illustrated but continues further, on the wagon 2. A corresponding situation applies to the other end 12 of the power line rod 9, in that the other end 12 of the power line rod 9 is connected there via another outgoing power line 19, likewise in the form of a power line cable, to a further connecting piece 20 of a high-voltage line, which is not illustrated but continues further, on the other wagon 3. Since the outgoing power lines 16 and 19 can be made relatively short, they do not increase the space requirement for the overall high-voltage connection in order to maintain flash-over-resistant air gaps.

Figure 3:
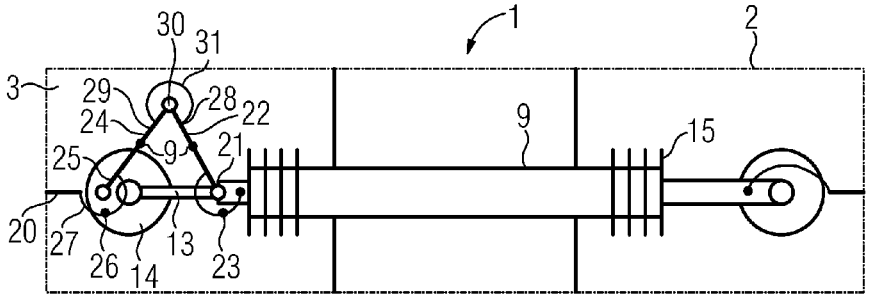
FIG. 3 shows a plan view of another exemplary embodiment, with the roof of the rail vehicle removed.

The plan view of the exemplary embodiment shown in FIG. 3 corresponds essentially to the exemplary embodiment illustrated in FIGS. 1 and 2, as a result of which corresponding reference symbols are used for the same parts, but this differs from the exemplary embodiment shown in FIGS. 1 and 2 by the connection of the power line rod 9 to the outgoing power line 19. Therefore, in this case, one end 21 of a power line arm 22 is connected to the power line rod 9, to be precise such that this arm 22 can rotate horizontally, that is to say it runs flat under the roof, which is not shown here, of the other wagon 3. The electrical connection between the power line rod 9 and the power line arm 22 is made via a connecting cable 23. A further power line arm 24 is mounted at one of its ends 25 with a connecting plate 26, which is held on the other supporting insulator 14, such that it can rotate horizontally, and is connected via a further connecting cable 27 to the other connecting piece 20. The respective other ends 28 and 29 of the two power line arms 22 and 24 are connected to one another at a bearing point 30 such that they can rotate horizontally, and this bearing point 30 is electrically bridged by a third connecting cable 31. The two power line arms 22 and 24 open like the blades of shears depending on how far the power movement piece 13 has been pulled out of the power line rod 9, in order to compensate for the distance changes between the two wagons 2 and 3, and their supporting insulators 11 and 14.

The invention claimed is:

1. An electric rail vehicle, comprising:

at least two rail cars with ends facing one another; each of said at least two rail cars having a high-voltage line routed in a roof thereof and each having a supporting insulator at the roof in an area of said ends; a high-voltage connection between said supporting insulators, the high-voltage connection including:

a power line rod having a first end mounted to a first one of said two supporting insulators, and a second end mounted to a second one of said two supporting insulators, said first end being mounted such that said rod is movable relative to said first supporting insulator;

an insulating body surrounding said rod; and an outgoing power line electrically connected to said high-voltage line of a first one of said rail cars and to said first end of said power line rod and a further outgoing power line electrically connected to said high-voltage line of a second one of said rail cars and to said second end of said power line rod.

2. The rail vehicle according to claim 1, wherein each of said outgoing power lines is a power line cable firmly connected to said power line rod.

3. The rail vehicle according to claim 1, wherein each of said outgoing power lines is a power line cable connected to said power line rod by a respective sliding contact.

4. The rail vehicle according to claim 1, wherein said power line rod is mounted on the supporting insulators for spherical movement or with a universal-joint connection.

5. The rail vehicle according to claim 1, wherein said power line rod has a sliding piece which slides longitudinally in said rod and has an end held on said second supporting insulator.

6. The rail vehicle according to claim 1, wherein said insulating body extends over an entire area between said ends of said at least two rail cars.

* * * * *